US006056674A

United States Patent [19]

Cook

[11] Patent Number: 6,056,674

[45] Date of Patent: May 2, 2000

[54] METHOD AND APPARATUS FOR BOXING

[76] Inventor: Arnold J. Cook, 413 N. Pasadena Dr., Pittsburgh, Pa. 15215

[21] Appl. No.: 09/062,284

[22] Filed: Apr. 17, 1998

[51] Int. Cl.[7] ..... A63B 69/00; A63B 69/02

[52] U.S. Cl. ..... 482/83; 482/11; 482/90

[58] Field of Search ..... 482/11, 83–84, 482/87, 90

[56] References Cited

U.S. PATENT DOCUMENTS

| | | | |
|---|---|---|---|
| 3,866,909 | 2/1975 | DeSantis | 482/83 |
| 4,534,557 | 8/1985 | Bigelow et al. | 482/83 |
| 4,763,284 | 8/1988 | Carlin | 482/84 |
| 4,823,462 | 4/1989 | Huber | 73/118.2 |
| 4,824,107 | 4/1989 | French | 482/12 |
| 4,941,660 | 7/1990 | Winn et al. | 482/84 |

FOREIGN PATENT DOCUMENTS

| | | | |
|---|---|---|---|
| 01827278 | 7/1993 | U.S.S.R. | 482/12 |

*Primary Examiner*—Jerome Donnelly
*Attorney, Agent, or Firm*—Ansel M. Schwartz

[57] ABSTRACT

An apparatus for boxing. The apparatus includes clothing adapted to be worn by a boxer which protects the boxer from punches of another boxer. The apparatus includes a sensor mechanism which senses when a punch contacts the clothing. The sensor mechanism is in contact with the clothing. The apparatus includes a display mechanism which identifies when a punch contacts the clothing. The display mechanism is in communication with the sensor mechanism. A method for boxing. The method comprises the steps of punching clothing on a boxer which protects the boxer from punches. Then there is the step of sensing with a sensor mechanism in the clothing when a punch having at least the predetermined level of force contacts the clothing. Next there is the step of displaying with a displaying mechanism when a punch having at least the predetermined level of force contacts the display.

8 Claims, 12 Drawing Sheets

METHOD AND APPARATUS FOR BOXING

FIELD OF THE INVENTION

The present invention is related to boxing. More specifically, the present invention is related to safe boxing that uses sensors to determine when a hit, such as a punch, strikes a boxer.

BACKGROUND OF THE INVENTION

Boxing and some contact martial arts sports are being forced underground and out of existence because of the damage the athletes sustain in a fight. These sports are some of the oldest known to man and unless something is done soon, public support will end these sports. A number of countries have already outlawed professional boxing, such as Sweden. Only amateur boxing with protective headgear is permitted. The Air Force, which had boxing as a mandatory training requirement was just forced through public pressure to release the mandatory status. Boxing is still mandatory in the Army and Navy, but it, as well as boxing in the Olympics, is being threatened. Why is the public and the medical community working so hard to have these sports extinguished, while at the same time paying millions of dollars to athletes who participate?

Medical research has shown that boxing and contact martial arts causes various medical problems. Since the goal of the sport, like all sports, is to win and the quickest way to win is by knockout, most of the injuries are due to trauma to the head. Concussions, brain damage, mouth, eye, ear damage, and even death may occur. It is well known that professional boxers can develop chronic traumatic encephalopath (dementia pugilistics). Analysis of ex-boxers' brains show the same traits as that of Alzheimer's Disease. Pharyngoesophageal perforation secondary to blunt neck trauma, which can occur with boxing can cause serious morbidity and mortality if not recognized and treated. Psychomotor performance and cognitive functions are also affected by chronic trauma and may cause the onset of Parkinson's Disease. Eye damage often occurs including injury to the eye lid, angle abnormalities, slight lens opacities, posterior vitreous detachment, peripheral retinal scars, retinal tears, and atrophic holes. But knockouts are the worst. A knockout in boxing entails a deliberate state of unconsciousness. Acute Subdural Hematoma, which is the most common acute brain injury in boxing, accounts for 75% of all acute brain injuries and is the leading cause of boxing fatalities.

There have now been many medical studies which have concluded that the use of protective headgear greatly reduces the chance of any injury from brain to eye damage. The problem with headgear is that it does not provide the feedback required for amateur fights, which makes scoring difficult. For professional fighters, the lack of feedback and protection of headgear means that the force behind a punch has less meaning and less excitement for fans. Professional boxers therefore, fight without headgear.

The proposed product will have the ability to both protect the boxers and martial artists, while at the same time reward the boxers and excite the fans by providing force and punch feedback. There are an enormous number of possible future developments for training as well as standardizing scoring.

This product is designed to give new life to boxing and the martial arts, which will be forced out of existence otherwise. The product will prevent death, brain damage, eye damage, and other trauma, while at the same time provide fans and the boxing competitor with more information such as the force of a punch, number of punches and location of punches. It will also allow referees to respond to punches below the belt and call technical knockouts based on punch data, not brain damage. Trainers and athletes will be able to use the product to become more effective and monitor their performance.

SUMMARY OF THE INVENTION

The present invention pertains to an apparatus for boxing. The apparatus comprises clothing adapted to be worn by a boxer which protects the boxer from punches of another boxer. The apparatus comprises a sensor mechanism which senses when a punch contacts the clothing. The sensor mechanism is in contact with the clothing. The apparatus comprises a display mechanism which identifies when a punch contacts the clothing. The display mechanism is in communication with the sensor mechanism.

The present invention pertains to a method for boxing. The method comprises the steps of punching clothing on a boxer which protects the boxer from punches. Then there is the step of sensing with a sensor mechanism in the clothing when a punch having at least the predetermined level of force contacts the clothing. Next there is the step of displaying with a display mechanism when a punch having at least the predetermined level of force contacts the display.

Preferably, the head gear is comprised of a foam layer, the air bag is disposed over the foam layer; and protective pieces made of metal or plastic for fitting over the eyes, nose, chin and ears are disposed between the foam layer and the air bag. The body gear includes pressure sensor(s) and preferably includes EKG sensors 44 adapted to contact the boxer's body which monitors the heart rate of the boxer, and the transmitter connected to each sensor for transmitting the EKG sensed by the associated sensor to the receiver, as shown in FIG. 20. Preferably, the clothing includes a glove having a pressure sensor and a transmitter connected to the pressure sensor for transmitting, announcing or displaying the force of each punch which contacts another boxer.

The present invention pertains to a punching pad. The punching pad comprises a glove portion which is adapted to receive a hand. The punching pad comprises a pad portion attached to the glove portion which is adapted to receive punches. The punching pad comprises a sensor mechanism in contact with the pad portion for sensing when a punch having at least a predetermined amount of force contacts the pad portion. The punching pad comprises a display mechanism which identifies when a punch contacts the pad portion having the minimum predetermined amount of force. The display can show the actual force from 0.1 pound to 1,000 pounds, for example.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
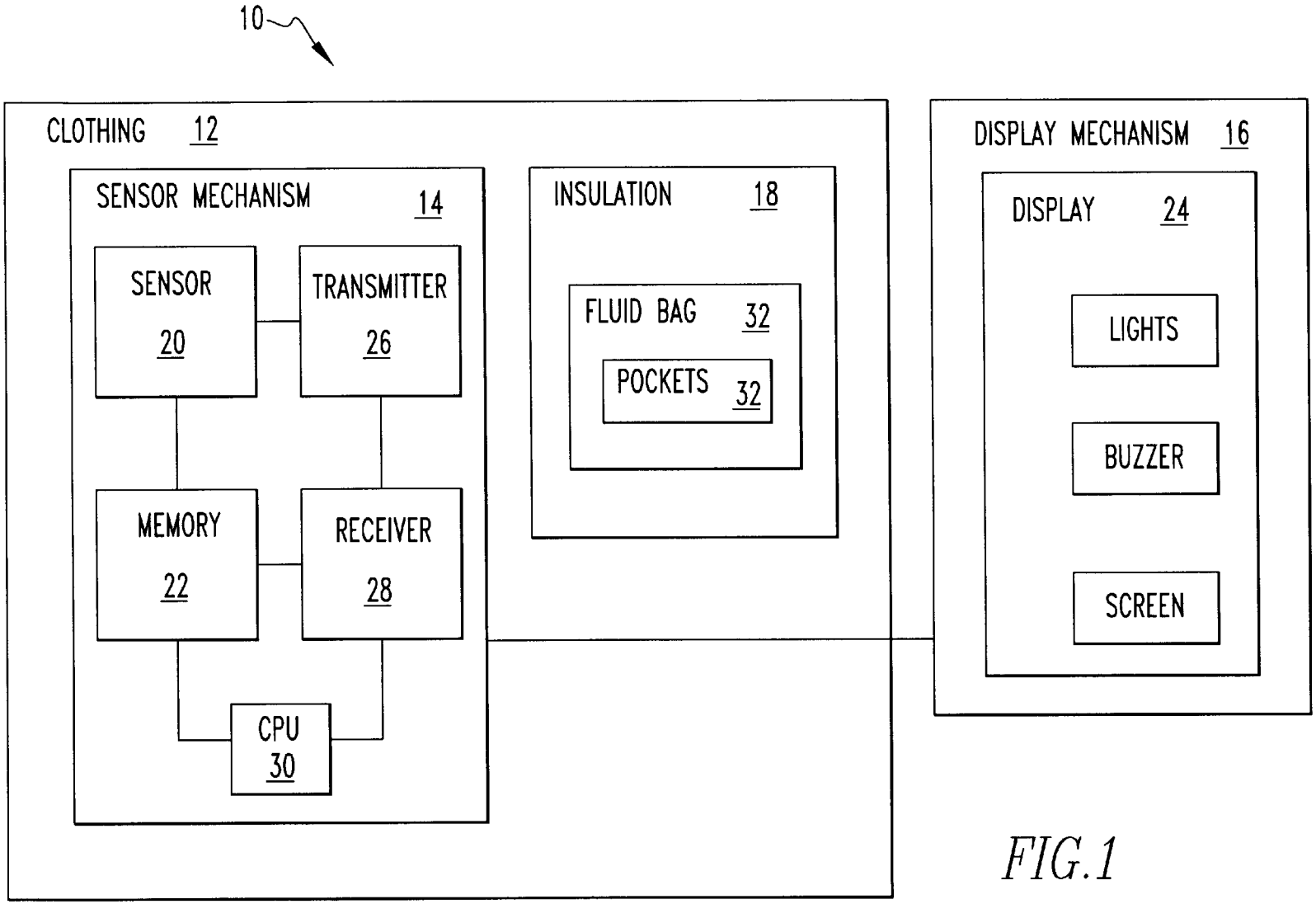
FIG. 1 is a schematic representation of an apparatus of the present invention.
Figure 2A:
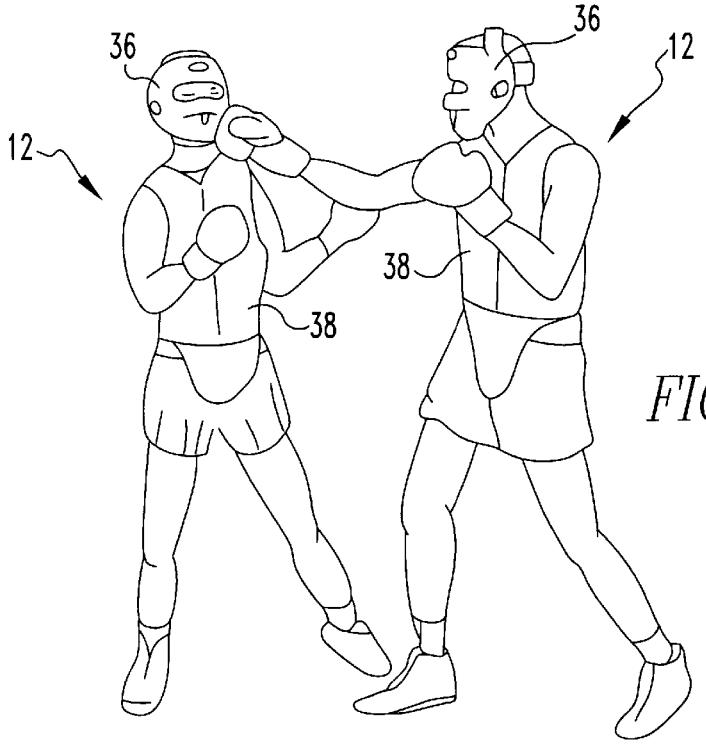
FIG. 2*a* shows two boxers boxing using the apparatus.
Figure 2B:
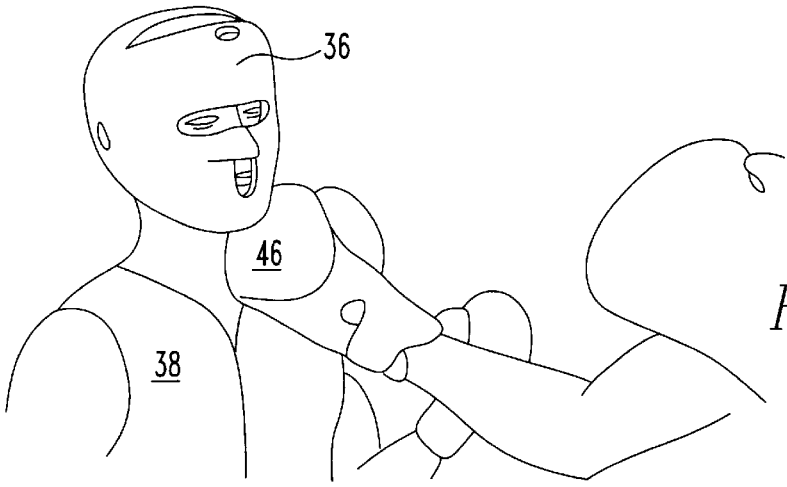
FIGS. 2*b*, 2*c* and 2*d* show different types of punches to a boxer using the apparatus.
Figure 2C:
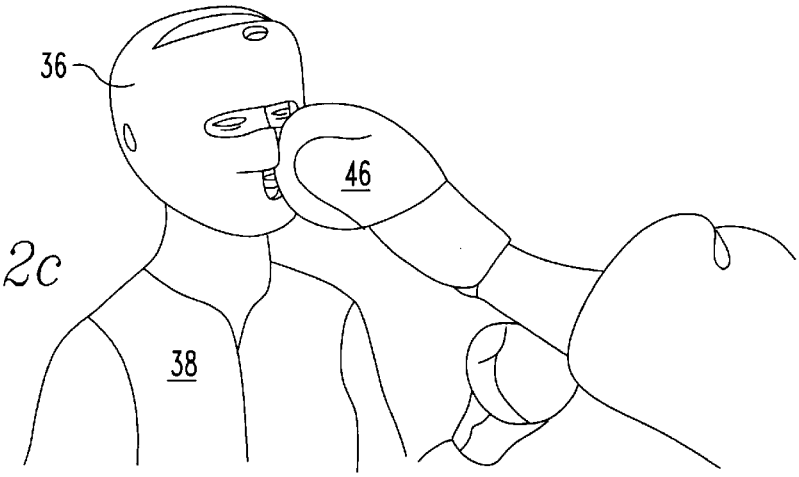
Figure 2D:
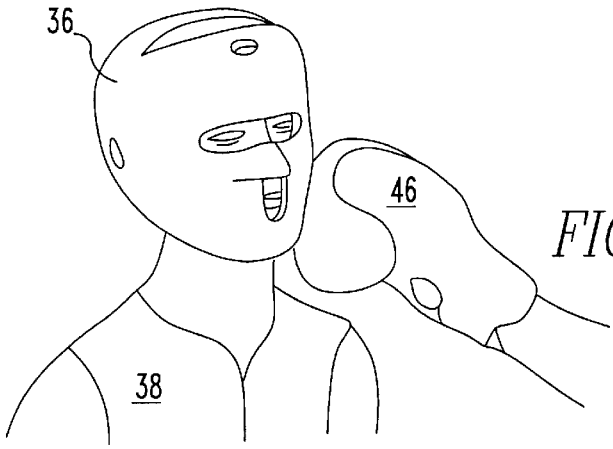
Figure 4:
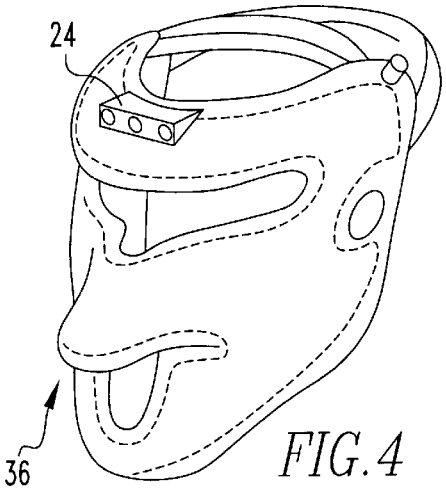
FIGS. 4, 5, 6 and 7 are schematic representations of the head gear of the apparatus.
Figure 5:
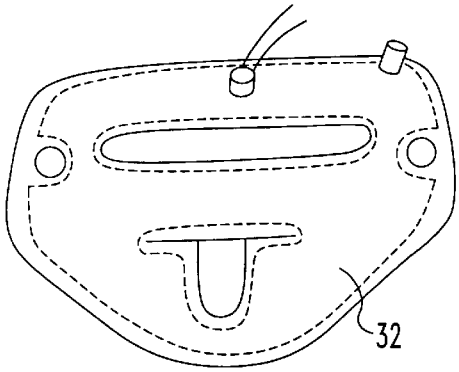
Figure 6:
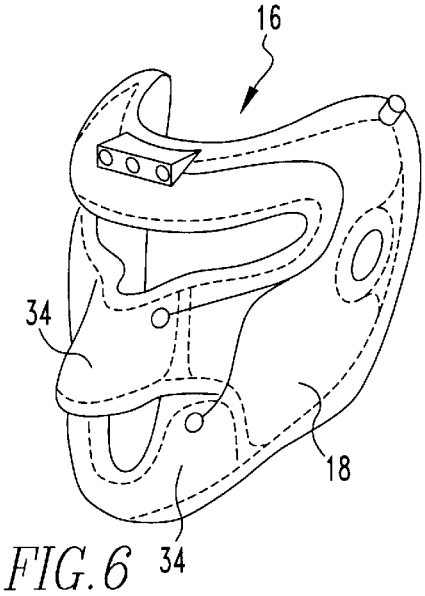
Figure 7:
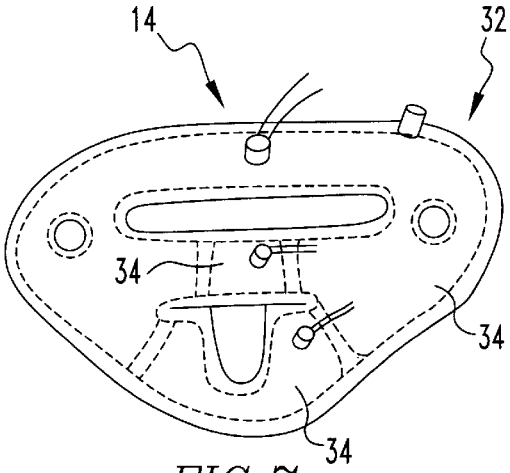

Referring now to the drawings wherein like reference numerals refer to similar or identical parts throughout the several views, and more specifically to FIGS. 1 and 2*a* thereof, there is shown an apparatus 10 for boxing. The apparatus 10 comprises clothing 12 adapted to be worn by a boxer which protects the boxer from punches of another boxer. The punches can be caused by any type of a hit, such as a kick from a leg or a jab or hook or cross or any type of punch from the arm, as shown in FIGS. 2*b,* 2*c* and 2*d.* The apparatus 10 comprises a sensor mechanism 14 which senses when a punch contacts the clothing 12 and can sense the force of the punch. The sensor mechanism 14 is in contact with the clothing 12. The apparatus 10 comprises a display mechanism 16 which identifies when a punch contacts the clothing 12. The display mechanism 16 is in communication with the sensor mechanism 14. The display mechanism 16 can be an audio or video display 24. For instance, the display mechanism 16 can announce the amount of force exerted from a punch, such as 50 psi, it could also announce location of the punch, and other status information.

Preferably, the clothing 12 includes insulation 18 which absorbs force from a punch contacting the clothing 12 and protects the boxer wearing the clothing 12 from the punch. Preferably, the clothing 12 includes head gear 36 and body gear 38.

Figure 3:
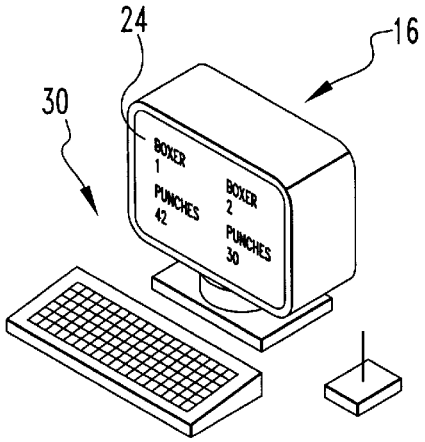
FIG. 3 is a schematic representation of a computer with a display.

The sensor mechanism 14 preferably senses when a punch having at least a predetermined amount of force contacts the clothing 12. Preferably, the display mechanism 16 includes a display 24 which shows when a punch having a force greater than the predetermined amount of force contacts the clothing 12, as shown in FIG. 3.

Preferably, the sensor mechanism 14 is adjustable so the predetermined amount of force can be changed. The sensor mechanism 14 preferably includes at least one sensor 20 which senses the force of a punch contacting the clothing 12, and a memory 22 connected to the sensor mechanism 14 which stores the amount of force of each punch.

The sensor mechanism 14 preferably includes a transmitter 26 connected to the sensor 20 to transmit a signal corresponding to the force of each punch contacting the clothing 12 having the predetermined amount of force, and a receiver 28 remote from the transmitter 26 which receives the signal and stores it in the memory 22 connected to the receiver 28. Preferably, the sensor mechanism 14 includes a CPU 30 which receives the signal and determines an injury that would result in the boxer had the punch contacted the boxer if no insulation 18 was present in the clothing 12, as shown in FIG. 3.

The insulation 18 preferably includes a fluid bag 32 having a fluid, such as air, in it, as shown in FIGS. 4, 5, 6 and 7. The sensor 20 is in fluidic communication with the fluid. The sensor 20 preferably includes a pressure sensor 20 which senses the pressure of the fluid. The pressure of the fluid increases when the fluid bag 32 is compressed when a punch strikes the air bag. Preferably, the fluid bag 32 has a plurality of fluid pockets 34, and the sensor 20 has a pressure sensor 20 in fluidic communication with each pocket 34. The transmitter 26 is connected to each pressure sensor 20. The CPU 30 preferably determines which pockets 34 the signal was transmitted from.

Figure 8:
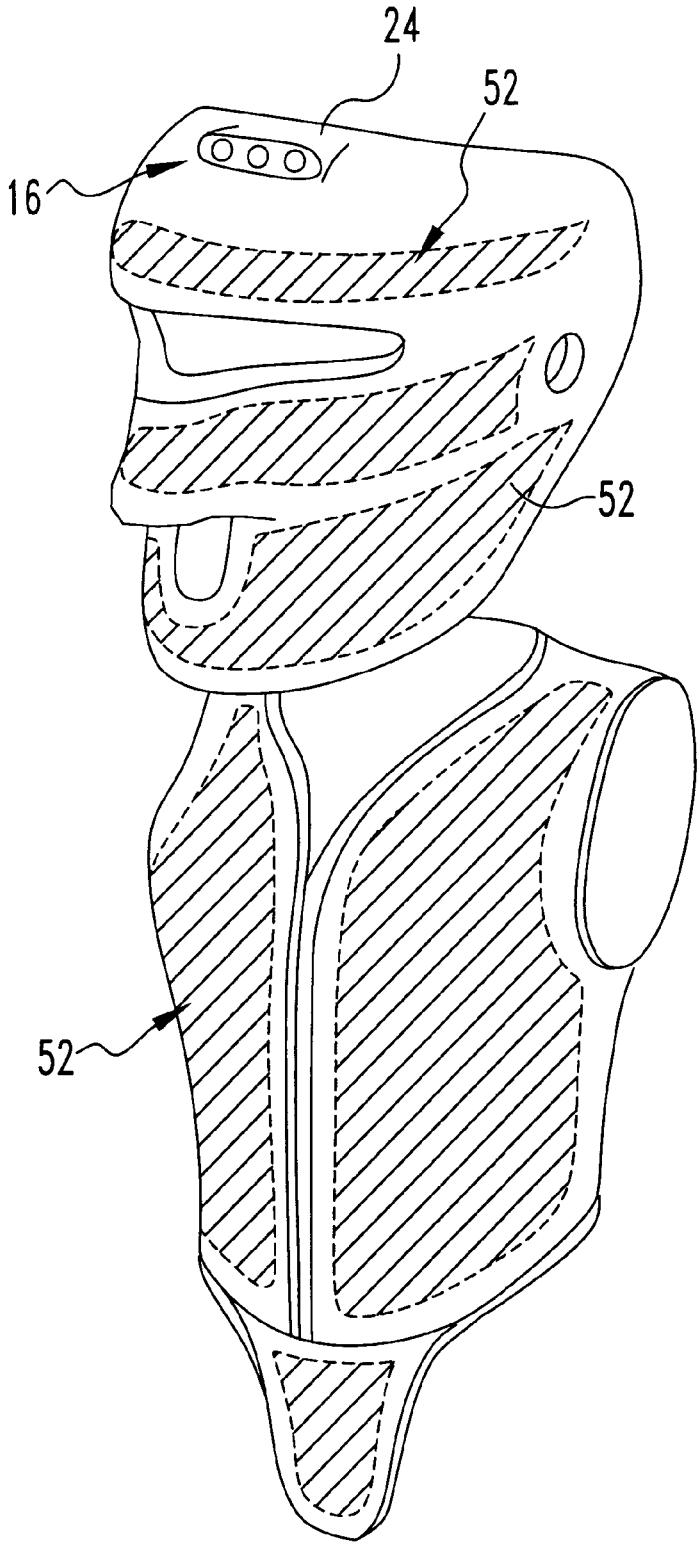
FIG. 8 is a schematic representation of clothing of the apparatus.

Alternatively, the insulation 18 includes foam and the sensor mechanism 14 includes kapton sensors 52, or strain gages in contact with the foam which produces a signal when they are contacted, as shown in FIG. 8. The sensor mechanism 14 includes a transmitter 26 connected to the sensors 20 which transmits the signals, and a receiver 28 remote from the transmitter 26 which receives the signal from the transmitter 26 and provides the signal to the CPU 30 which determines the location of a punch on the boxer.

Figure 9:
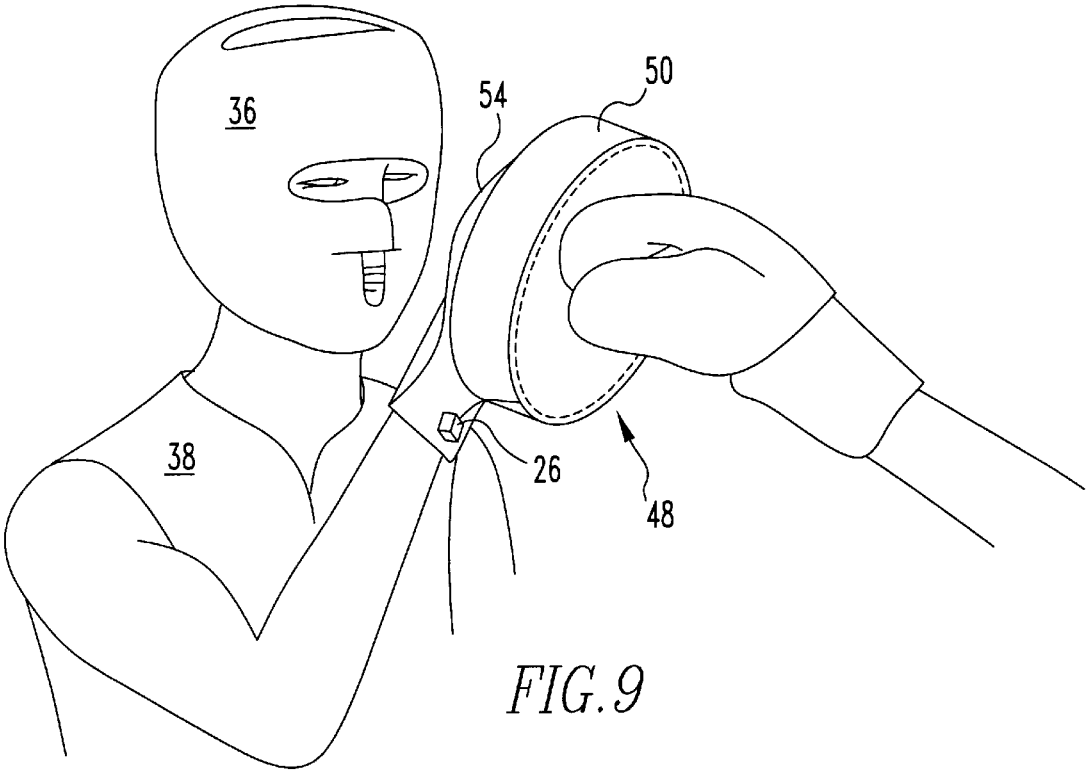
FIG. 9 is a schematic representation of a punching pad.
Figure 10:
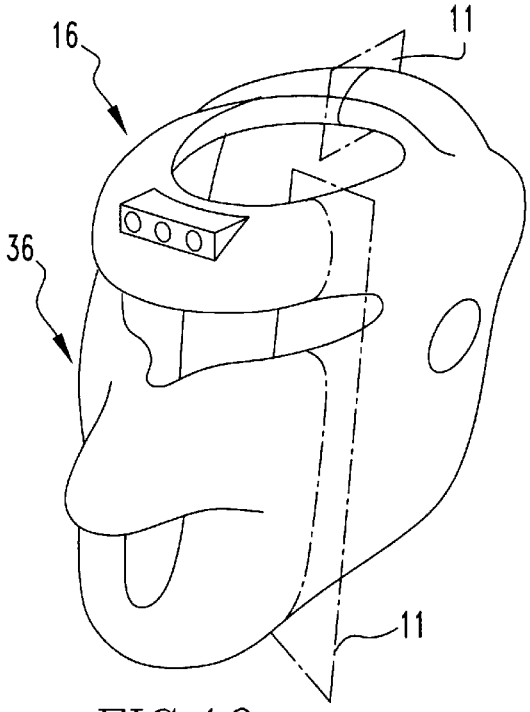
FIG. 10 is a schematic representation of head gear.
Figure 11:
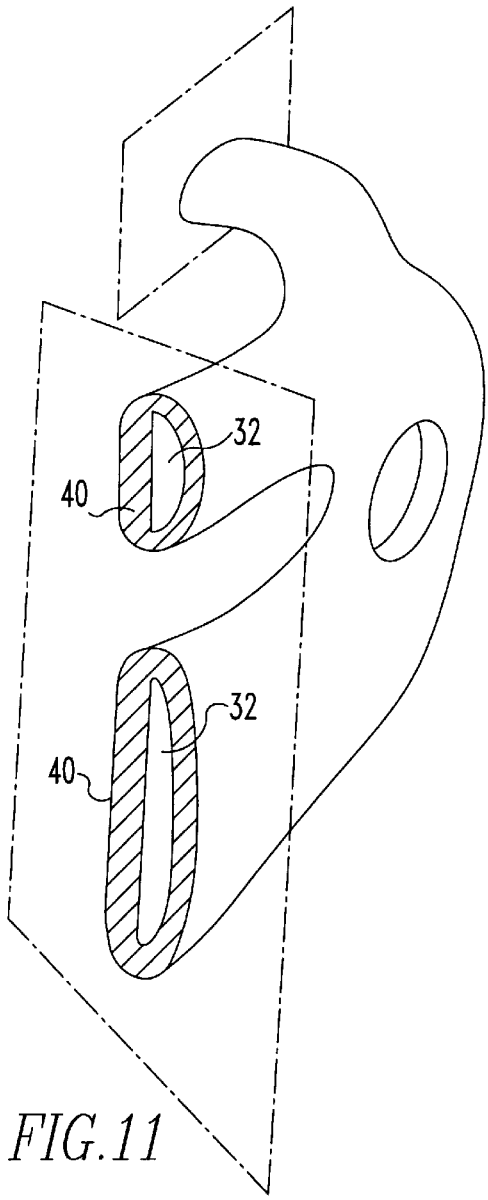
FIG. 11 is a cut-away view of FIG. 10.
Figure 12:
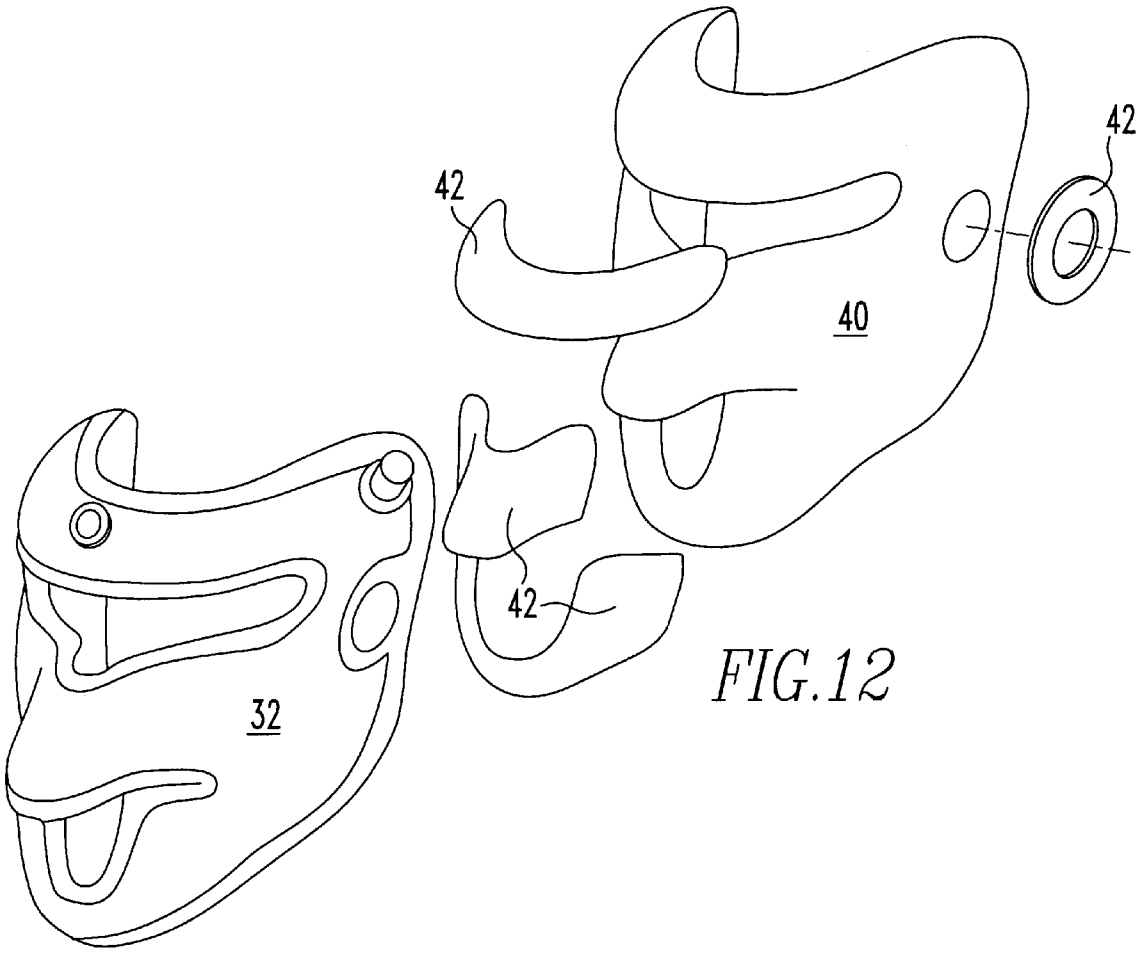
FIG. 12 is a schematic representation of head gear.
Figure 14:
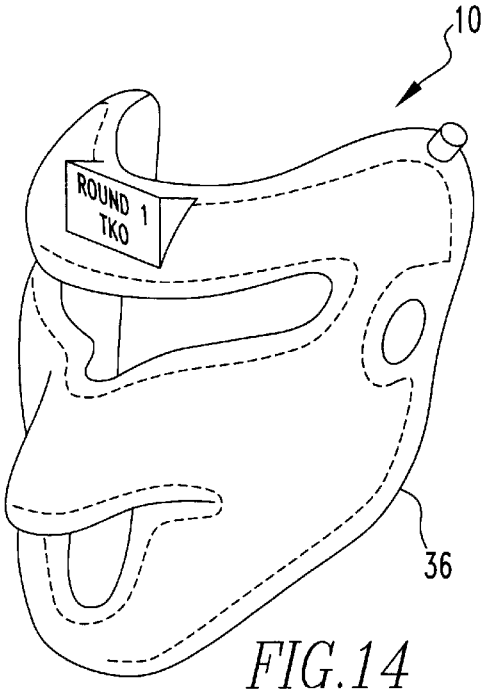
FIGS. 13 and 14 are schematic representations of head gear.
Figure 13:
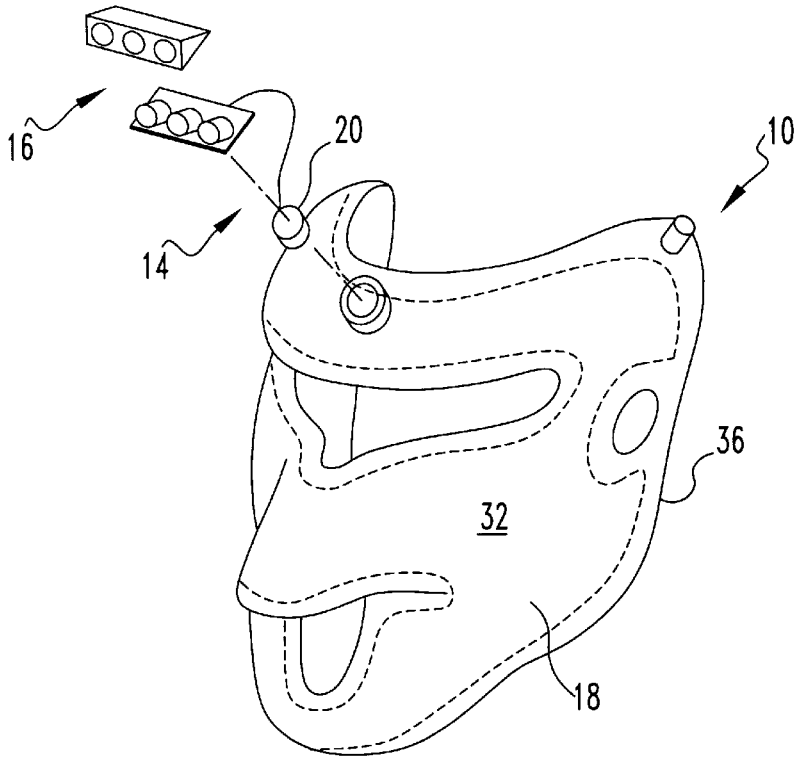

The present invention pertains to a punching pad 48, as shown in FIG. 9. The punching pad 48 comprises a glove portion 54 which is adapted to receive a hand. The punching pad 48 comprises a pad portion 50 attached to the glove portion 54 which is adapted to receive punches. The punching pad 48 comprises a sensor mechanism 14 in contact with the pad portion 50 for sensing when a punch having at least a predetermined amount of force contacts the pad portion 50. The punching pad 48 comprises a display mechanism 16 which identifies when a punch contacts the pad portion 50 having the predetermined amount of force.

The present invention pertains to a method for boxing. The method comprises the steps of punching clothing 12 on a boxer which protects the boxer from punches. Then there is the step of sensing with a sensor mechanism 14 in the clothing 12 when a punch having at least the predetermined level of force contacts the clothing 12. Next there is the step of displaying with a display mechanism 16 when a punch having at least the predetermined level of force contacts the display 24.

In the operation of the preferred embodiment, boxers can box each other in safety by using protective clothing 12 that has padding and insulation 18 to protect them from the punches of the other boxer, yet still enjoy the sport and the competition through the use of sensors 20 in the clothing 12 that indicate the contact of a punch by a boxer, and the effect of the punch.

The clothing 12 is comprised of head gear 36, body gear 38 and gloves 46. The head gear 36 has an inner layer of foam 40 which serves as padding and insulation 18 against the force of a punch against the head, as shown in FIGS. 10, 11, 12, 13 and 14. Placed about the ear section of the foam, the eye section of the foam, the nose section of the foam and the chin and mouth section of the foam are protective metal or plastic pieces that further protect these respective sensitive areas on the head of the boxer. These protective pieces 42 serve to deflect force that is incident on them to the foam where it is spread out and dissipated so it does not harm the boxer who is punched in the head.

Over the foam and protective pieces 42 is an air bladder that further serves to act as padding and insulation 18 against the blows from a boxer punching the head. The air bladder also functions as a sensor 20, where the air in the bladder, when compressed from the force of a punch landing on it, the air bladder causes the air and the bladder to increase in pressure. This increased pressure is in turn sensed by a pressure sensor 20 made by microswitch. The pressure sensor 20 can have a transmitter 26 connected to it to transmit a signal corresponding to the force of the punch received at the air bladder to a remote computer which receives the signal, or to an indicator, the air bladder which displays the fact the air bladder was contacted by a punch having a minimum amount of force necessary to be read by the pressure sensor and reach a level set electronically to indicate the punch was landed. The air bladder also has a nozzle through which the air bladder is filled.

The air bladder can have numerous pockets 34 to further define where a punch contacts the air bladder for more accurate determination of the effect of the punch which would otherwise have potentially injured the boxer being punched were it not for the air bladder and overall head gear 36 in place. By having multiple pockets 34 in the air bag, with each pocket 34 having its own pressure sensor 20 connected to the radio transmitter 26, or to the indicator on the head gear 36, the position of the punch on the air bag is better determined. Sensitive areas of the head the punches strike can better be identified in determining the effect the punch would have had if the air bag not been present. The head gear 36 can have straps that extend over the back of the head of the boxer to better hold the head gear 36 in place.

Figure 15:
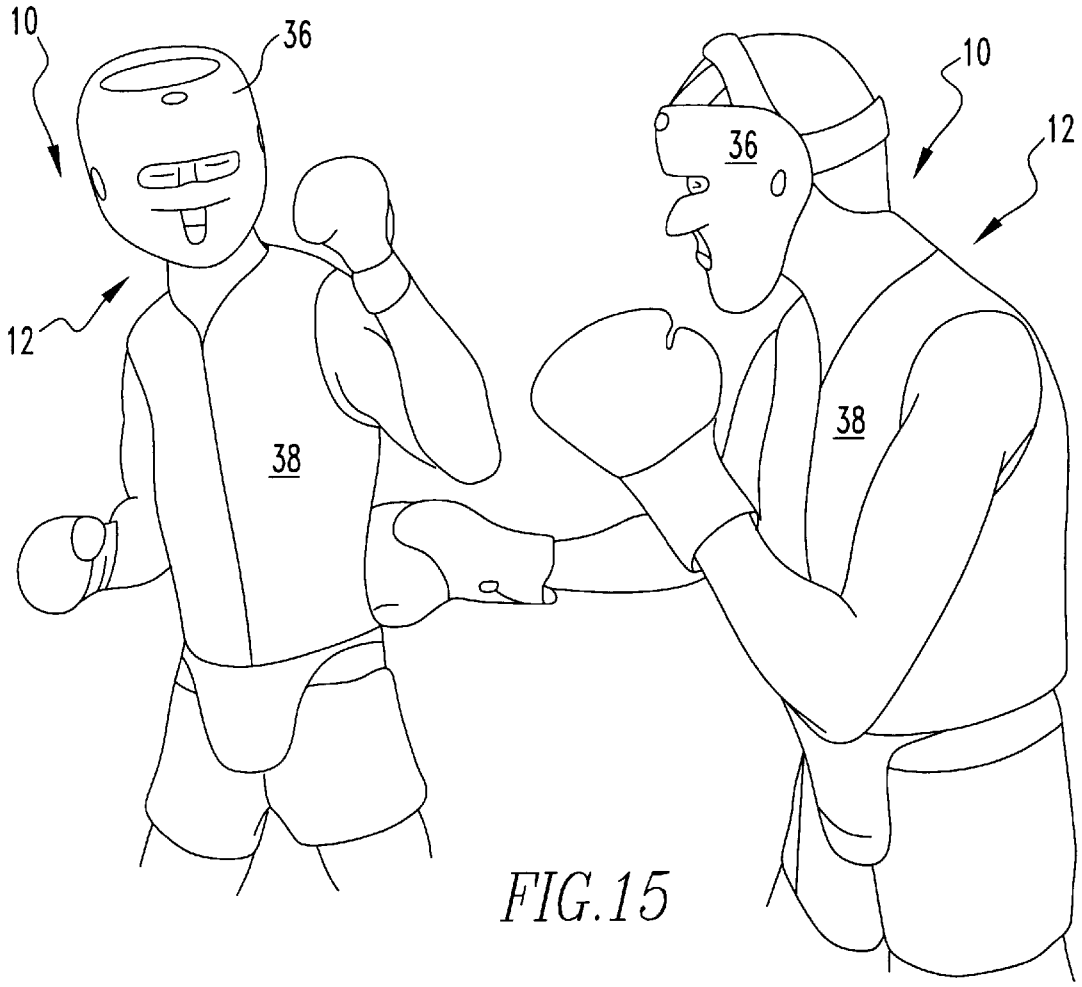
FIGS. 15 and 16 show boxers boxing where one boxer is throwing an illegal punch.
Figure 16:
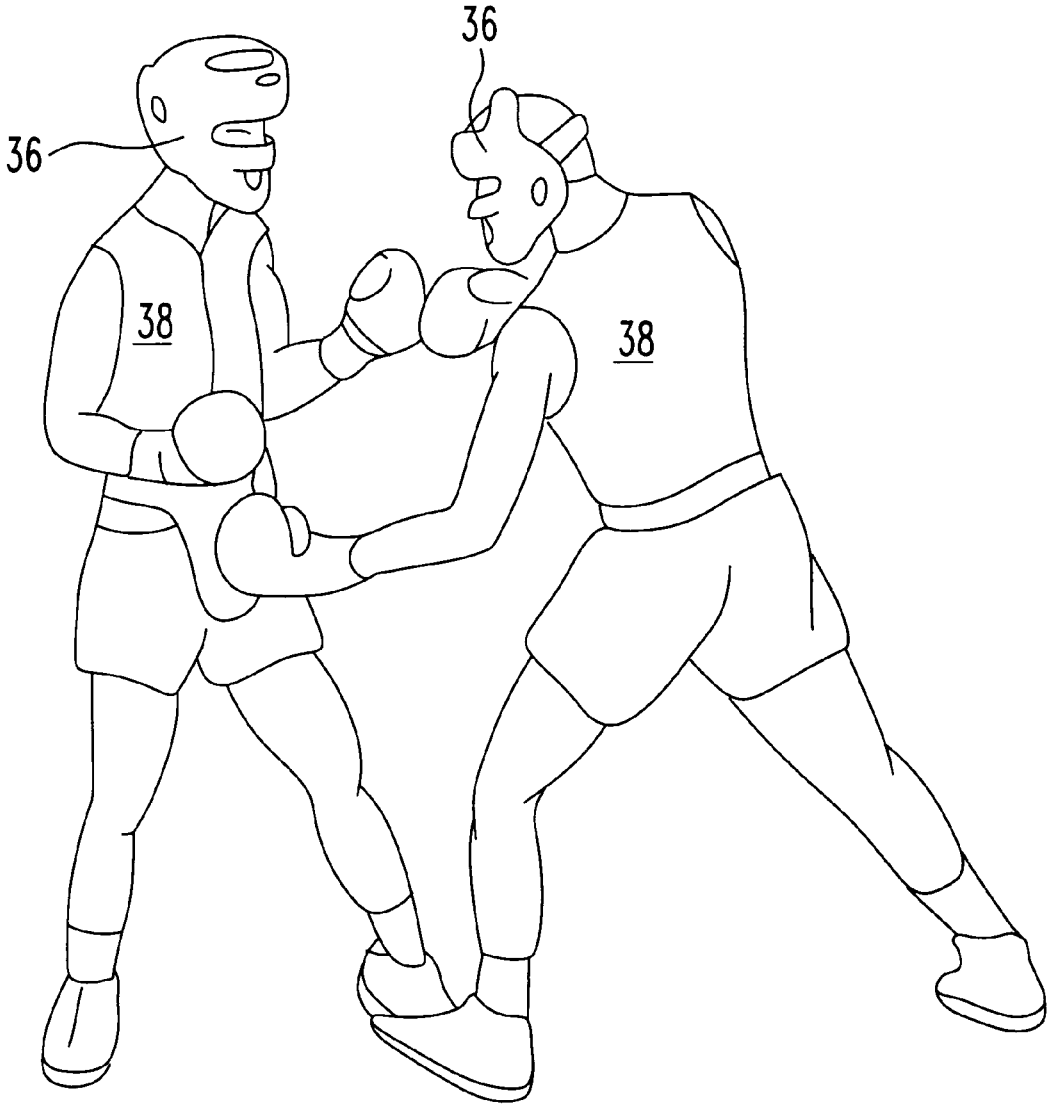

The vest is designed in the same fashion with either an air bag having no pockets 34, or the single air bag having multiple pockets 34 to better define the various regions in the body gear 38 punches strike the body. By placing pockets 34 in the air bag in the body gear 38, not only can the effects of punches at sensitive locations along the body be identified, but also illegal punches to, for instance, the kidney or "Below the belt" can be identified accurately, as shown in FIGS. 15 and 16, and a referee can deduct points or stop the match based on these illegal blows which might than otherwise be missed during the speed of a boxing match. The body gear 38 can be worn as a vest which covers the front and back of the body of the boxer and protects against vital and sensitive areas of the body so the boxer is not injured.

In the simplest use of the indicator, the indicator can be a single sensor 20 having a battery which powers the sensor 20 and a light or buzzer connected to the battery and the sensor 20 which illuminates or buzzes when a punch having a minimum amount of force causes the pressure sensor 20 to initiate the signal to activate the light or buzzer. In another embodiment, instead of there being a single light or buzzer, there can be multiple lights and also have the buzzer, or no buzzer. With multiple lights, the match can be started with all the lights on, and as the punches accumulate, the light goes off until all of the lights are out indicating the boxer has lost because his competitor has successfully landed enough punches to indicate he has won. With each successful punch being landed, the buzzer can be sounded to indicate the successful punch has been landed. The reverse operation of the lights going on can also be used.

In another embodiment, the light announcer (speaker) or buzzer can be replaced with a transmitter 26 which transmits the signal from the sensor 20 to a remote computer when a successful punch occurs. The remote computer can then tally the punches and keep track of the punches received by the boxer. In another embodiment, there can be numerous sensors 20 with transmitters transmitting signals to a receiver 28 at a computer which analyzes the information from the signals. There can also be lights and a buzzer for the reasons identified above and control buttons and recharge ports to reset the indicator and recharge the battery which powers the sensors 20, lights and buzzer.

In addition, in another embodiment, there can be a prom port. Cartridges having established programs are plugged into the prom port to cause a given match procedure to be followed, i.e., 3 rounds, or 7 rounds.

In another embodiment there can also be a display 24 on the indicator which can readout when a knockout occurs or some other information. There can be an upload and download port which transmits programs and data back and forth and plugs directly into the computer before or after a fight, and an indicator, as well as a battery, recharge port, control buttons and sensors 20.

Figure 17:
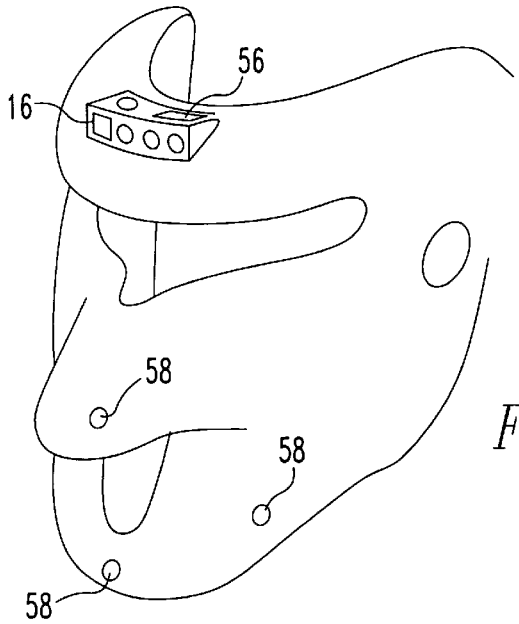
FIG. 17 is a schematic representation of head gear.
Figure 20:
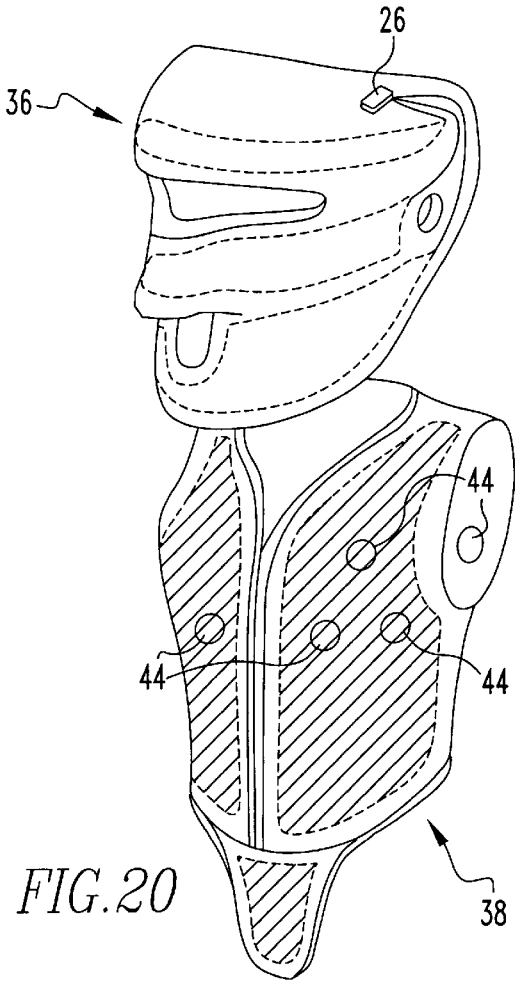
FIG. 20 is a schematic representation of clothing having EKG sensors.

In still another embodiment there can be a transmitter 26 connected to the sensors 20 which transmit signals from the sensors 20 to a receiver 28 connected to a computer processor. There can be a speaker and a microphone on the head gear 36 for the boxer to hear commands from a remote location and a microphone for the boxer to speak into for the boxer to converse with the person at a remote location. There can be lights, a buzzer, control buttons, a battery, battery port, control buttons, a calibration self test system and even indicator lights at a certain point in the head gear 36 to indicate where another boxer should punch for training purposes, as shown in FIG. 17.

Figure 18:
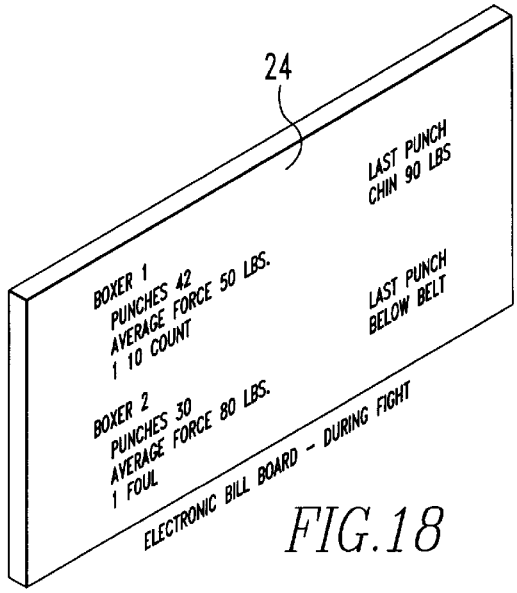
FIG. 18 is a schematic representation of a display.

In a more complex embodiment, the computer which receives signals from various sensors 20 in various pockets 34 can take the information to better identify the effects of the punches received by the boxer on the boxer's state. There can be a table look-up in a memory 22 of the computer which is programmed for a given boxer and a boxer's weight so that for a given punch at a given location having a given force, the severity of the punch on the boxer, had there been no protection to the boxer, can be identified. This can be accumulated based on a function of time since the more numerous the punches received in a smaller amount of time, results in a greater effect on the boxer. The computer can communicate with a display 24 that keeps track of various information about each of the boxers, including the number of punches landed on the boxer as well as the force of the punches, the status of the boxer in the fight and even the location of the last punch received by the boxer and the force of the punch, as shown in FIG. 18. The computer also runs the boxing match, keeping time and causing rounds to begin and end through the indicator on the head gear 36 and as mentioned above, keeping track of fouls where the boxer has legally punched the other boxer.

The boxer during training can use a punching pad 48 which fits on the hand of a sparring partner in a glove portion 54 of the punching pad 48. A sensor 20 in the pad senses the punch received by the boxer and transmits a signal to the computer which identifies information about the punch.

Figure 19:
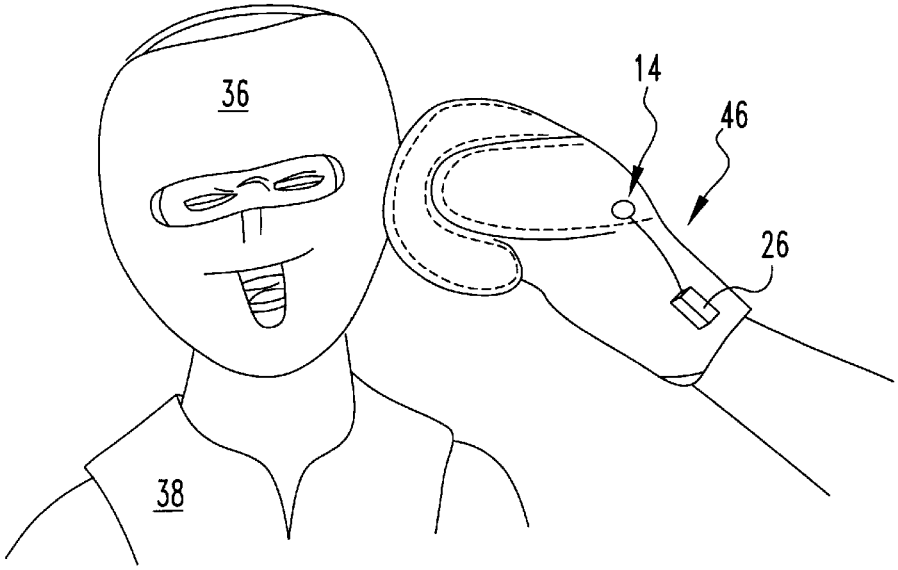
FIG. 19 is a schematic representation of a glove.

The glove 46 having padding and a sensor 20 with a transmitter 26 can serve as a redundancy to the sensors 20 on the body and head gear 36 which receive the punches, as shown in FIG. 19. The glove 46 also transmits the amount of force it impacts in the same way, and the sensor 20 which senses the force the glove 46 impacts. The "receiving" force and the "giving" force are essentially the same and the computer uses this fact to verify the force of the punch received by the boxer.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. An apparatus for boxing comprising:

clothing adapted to be worn by a boxer which protects the boxer from punches of another boxer, the clothing includes insulation which absorbs force from a punch contacting the clothing and protects the boxer wearing the clothing from the punch the insulation includes a fluid bag having a fluid in it;

a sensor mechanism which senses when a punch contacts the clothing, said sensor mechanism in contact with the clothing, the sensor mechanism senses when a punch having at least a predetermined amount of force contacts the clothing, the sensor mechanism is adjustable so the predetermined amount of force can be changed the sensor mechanism includes at least one sensor which senses the force of a punch contacting the clothing and a memory connected to the sensor which stores the amount of force of each punch, the sensor mechanism includes a transmitter connected to the sensor to transmit a signal corresponding to the force of each punch contacting the clothing having the predetermined amount of force and a receiver remote from the transmitter which receives the signal and stores it in the memory connected to the receiver the sensor mechanism includes a CPU which receives the signal and determines an injury that would result in the boxer had the punch contacted the boxer if no insulation was present in the clothing said sensor in fluidic communication with the fluid, said sensor including a pressure sensor which senses the pressure of the fluid, said pressure of the fluid increasing when the fluid bag is compressed when a punch strikes the fluid bag; and a display mechanism which identifies when a punch contacts the clothing, said displaying mechanism in communication with said sensor mechanism, the display mechanism includes a display which shows when a punch having a force greater than the predetermined amount of force contacts the clothing.

2. An apparatus as described in claim 1 wherein the fluid bag is an air bag, and the air bag has a plurality of fluid pockets, and the sensor has a pressure sensor in fluidic communication with each pocket and the transmitter is connected to each pressure sensor.

3. An apparatus as described in claim 2 wherein the CPU determines which pockets the signal was transmitted from.

4. An apparatus as described in claim 3 wherein the clothing includes head gear and body gear.

5. An apparatus as described in claim 4 wherein the head gear is comprised of a foam layer, the fluid bag is disposed over the foam layer; and protective pieces made of metal or plastic for fitting over the eyes, nose, chin and ears are disposed between the foam layer and the fluid bag.

6. An apparatus as described in claim 5 wherein the body gear includes EKG sensors adapted to contact the boxer's body which monitors the heart rate of the boxer, and the transmitter connected to each sensor for transmitting the EKG sensed by the associated sensor to the receiver.

7. An apparatus has described in claim 6 wherein the clothing includes a glove having a pressure sensor and a transmitter connected to the pressure sensor for transmitting the force of each punch which contacts another boxer.

8. A punching pad comprising:

a glove portion which is adapted to receive a hand;

a pad portion attached to the glove portion which is adapted to receive punches the pad includes a fluid bag having a fluid in it; and a sensor mechanism in contact with the pad portion for sensing when a punch having at least a predetermined amount of force contacts the pad portion, the sensor mechanism is adjustable so the predetermined amount of force can be changed, the sensor mechanism includes at least one sensor which senses the force of a punch contacting the pad portion, and a memory connected to the sensor which stores the amount of force of each punch, the sensor mechanism includes a transmitter connected to the sensor to transmit a signal corresponding to the force of each punch contacting the pad portion having the predetermined amount of force, and a receiver remote from the transmitter which receives the signal and stores it in the memory connected to the receiver, the sensor mechanism includes a CPU which receives the signal and determines an injury that would result in the boxer had the punch contacted the boxer if no pad, said sensor in fluidic communication with the fluid, said sensor including a pressure sensor which senses the pressure of the fluid, said pressure of the fluid increasing when the fluid bag is compressed when a punch strikes the fluid bag; and a display mechanism which identifies when a punch contacts the pad portion having the predetermined amount of force.

* * * * *